US005970577A

United States Patent [19]

Kim

[11] Patent Number: 5,970,577

[45] Date of Patent: Oct. 26, 1999

[54] BRUSH HEAD ASSEMBLY FOR A VACUUM CLEANER

[75] Inventor: Suk-Gu Kim, Seoul, Rep. of Korea

[73] Assignee: Daewoo Electronics Co., Ltd., Rep. of Korea

[21] Appl. No.: 08/997,333

[22] Filed: Dec. 23, 1997

[30] Foreign Application Priority Data

Dec. 27, 1996 [KR] Rep. of Korea ..... 96-73439

[51] Int. Cl.[6] ..... A47L 5/00

[52] U.S. Cl. ..... 15/398; 15/414; 15/416; 15/417

[58] Field of Search ..... 15/416, 398, 417, 15/414, 415.1

[56] References Cited

U.S. PATENT DOCUMENTS

| | | | |
|---|---|---|---|
| 1,016,649 | 2/1912 | Spencer | 15/417 |
| 2,844,841 | 7/1958 | Bergquist | 15/417 |
| 2,873,469 | 2/1959 | Borkoski | 15/417 |
| 2,885,717 | 5/1959 | Lampe | 15/417 |
| 4,864,681 | 9/1989 | Hult et al. . | |
| 5,187,834 | 2/1993 | Stark | 15/415.1 |
| 5,502,870 | 4/1996 | Ragner et al. | 15/398 |

FOREIGN PATENT DOCUMENTS

| | | |
|---|---|---|
| 790 469 | 2/1958 | United Kingdom . |
| 1 230 627 | 5/1971 | United Kingdom . |

*Primary Examiner*—Robert J. Warden, Sr.
*Assistant Examiner*—Kaj K. Olsen
*Attorney, Agent, or Firm*—Pillsbury Madison & Sutro

[57] ABSTRACT

A brush head assembly for a vacuum cleaner having an improved structure. The brush head assembly has a brush head body having a triangle structure including a vertical plane to which an upholstery brush is attached, a lower plane horizontally which is formed at a lower portion of the vertical plane and having a dusting brush attached thereunder, and an inclined plane which is formed between the vertical plane and the lower plane, has a connecting pipe integrally formed on the inclined plane of the brush head body and extending upward at an angle of 90 degrees with respect to the inclined plane, and a neck pipe having a front end portion having a hemisphere shape which is inserted into the connecting pipe, a rear end portion which is inserted into an extension bar, and an inlet hole which is formed below the hemisphere shaped front end portion. The brush head body is rotatable about the neck pipe so that the vertical plane and the lower plane alternately make contact with a floor as the brush head body rotates. The brush head assembly for a vacuum cleaner can be used at various places to be cleaned without changing the brush assembly, so cleaning efficiency is improved.

8 Claims, 4 Drawing Sheets

BRUSH HEAD ASSEMBLY FOR A VACUUM CLEANER

BACKGROUND OF THE INVENTION

1. Field of the Invention

The present invention relates to a vacuum cleaner, and more particular to a brush head assembly for a vacuum cleaner.

2. Description of the Prior Art

A vacuum cleaner is an apparatus for sucking dust and impurities by suction generated by a blower assembly. Generally, the vacuum cleaner comprises a body having wheels mounted at both sides thereof, a blower assembly accommodated in the body for generating suction force, a duct collecting chamber for collecting dust and impurities, a control panel for controlling an operation of the vacuum cleaner, a brush assembly connected to the body for sucking dust and impurities from a floor, and a flexible hose for connecting the body with the brush.

FIG. 1 illustrates a conventional vacuum cleaner 100. As illustrated in FIG. 1, vacuum cleaner 100 has a main body 110 which is movable by wheels 112 mounted at both sides thereof, a brush assembly 120 for sucking dust and impurities from a floor, a control panel 140 for controlling an operation of vacuum cleaner 100, a flexible hose 130 which connects control panel 140 to main body 110 so as to allow dust and impurities to flow into main body 110, and an extension bar 150 for connecting control panel 140 and brush assembly 120.

The main body 110 is provided therein with a blower assembly (not shown) for generating suction force, and a dust collecting chamber 118 for collecting dust and impurities sucked by the blower assembly. In addition, a dust indicator 114 for displaying an amount of dust or impurities collected in collecting chamber 118 is provided on an upper surface of main body 110, and a cord reel 116 is provided at a rear portion of main body 110. The blower assembly includes a motor for generating a rotational force and a blowing fan which is rotated by the motor, thereby generating suction force.

In general, brush assembly 120 can be detachably coupled to extension bar 150 and can be equipped with various brushes corresponding to the place to be cleaned.

FIGS. 2A and 2B respectively show a brush assembly 210 having a dusting brush 218 and a brush assembly 220 having an upholstery brush 228. Brush assembly 210 is used for cleaning a floor or a window frame. Brush assembly 210 comprises a brush body 214 provided at its underside 216 with dusting brush 218, and a connecting pipe 212 which is integrally formed with brush body 214 and is connected to an extension bar. At a center of underside 216 of brush body 214, there is formed a suction hole 215 for sucking air containing dust or impurities. Dusting brush 218 prevents brush body 214 from adhering to the floor caused by suction due to the operation of the blower assembly so that dust or impurities adhering to the floor are easily separated from the floor.

Brush assembly 220 is used for removing a thread or hairs which adheres to a carpet or a sofa. Brush assembly 220 is provided with a brush body 224, upholstery brush 228 adhered to an edge 226 of brush body 224, and a connecting pipe 222 which is integrally formed with brush body 224 and is connected to an extension bar. At a center of an underside of brush body 224, there is formed a suction hole 225 for sucking air containing dust or impurities.

While the cleaning is being performed, the user can selectively couple brush assemblies 210 and 220 to the extension bar corresponding to the place to be cleaned, thereby effectively carrying out the cleaning thereof.

However, when such brush assemblies 210 and 220 are used, the user should purchase both brush assemblies 210 and 220. In addition, if the use of one brush assembly is required while the other brush assembly is being used, the user should separate the other brush assembly from the extension bar so as to replace it with the required brush assembly, thereby resulting in a waste of time.

Furthermore, the user should separately store the various brush assemblies in a storing place after the cleaning is finished. Otherwise, the brush assemblies will be lost.

SUMMARY OF THE INVENTION

Accordingly, the present invention has been made to solve the foregoing problems, and an object of the present invention is to provide a brush head assembly for a vacuum cleaner which can be used at various places to be cleaned without changing the brush assembly, which can be easily handled, and which can reduce the manufacturing cost thereof.

In order to achieve the above object, the present invention provides a brush head assembly for a vacuum cleaner, the brush head assembly comprising:

a brush head body having a triangle structure including a vertical plane to which an upholstery brush is attached, a lower plane horizontally which is formed at a lower portion of the vertical plane and having a dusting brush attached thereunder, and an inclined plane which is formed between the vertical plane and the lower plane;

a connecting pipe which is integrally formed on the inclined plane of the brush head body and extends upward at an angle of 90 degrees with respect to the inclined plane; and a neck pipe having a front end portion having a hemisphere shape which is inserted into the connecting pipe, a rear end portion which is inserted into an extension bar, and an inlet hole which is formed below the hemisphere shaped front end portion, wherein the brush head body is rotatable about the neck pipe so that the vertical plane and the lower plane alternately make contact with a floor as the brush head body rotates.

According to a preferred embodiment of the present invention, the inclined plane is inclined at an angle of 45 degrees with respect to the lower plane. The connecting pipe is formed at an inner circumference surface thereof with a slot into which a ring is inserted. And, the neck pipe is formed at an outer circumference surface thereof with a slot into which a ring is inserted.

A first V-shaped depression part is formed at the vertical plane of the brush head body, and a second V-shaped depression part is formed at the lower plane of the brush head body. The first V-shaped depression part is formed with a first suction hole defined by a first semicircular opening and a second semicircular opening which are formed opposite to each other about a longitudinal center axis of the first V-shaped depression part, and the second V-shaped depression part is formed with a second suction hole defined by the second semicircular opening and a third semicircular opening which are formed opposite to each other about a longitudinal center axis of the second V-shaped depression part.

When cleaning is carried out using the upholstery brush, the user rotates the brush head body by an angle of 180 degrees. As a result, the upholstery brush makes contact with the floor.

On the other hand, when cleaning is carried out using the dusting brush, the user again rotates the brush head body by an angle of 180 degrees. As a result, the dusting brush makes contact with the floor.

The brush head assembly for a vacuum cleaner can be used at various places to be cleaned without changing the brush assembly to be used, so cleaning efficiency is improved.

Furthermore, the brush head assembly of the present invention can be simply manufactured by a molding process, so the manufacturing cost is reduced.

In addition, the brush head assembly of the present invention has a simple construction and can be easily handled.

BRIEF DESCRIPTION OF THE DRAWINGS

The above object and advantages of the present invention will become more apparent by describing in detail a preferred embodiment thereof with reference to the attached drawings, in which.

DETAILED DESCRIPTION OF THE INVENTION

Hereinafter, a preferred embodiment of the present invention will be explained in more detail with reference to the accompanying drawings.

Figure 1:
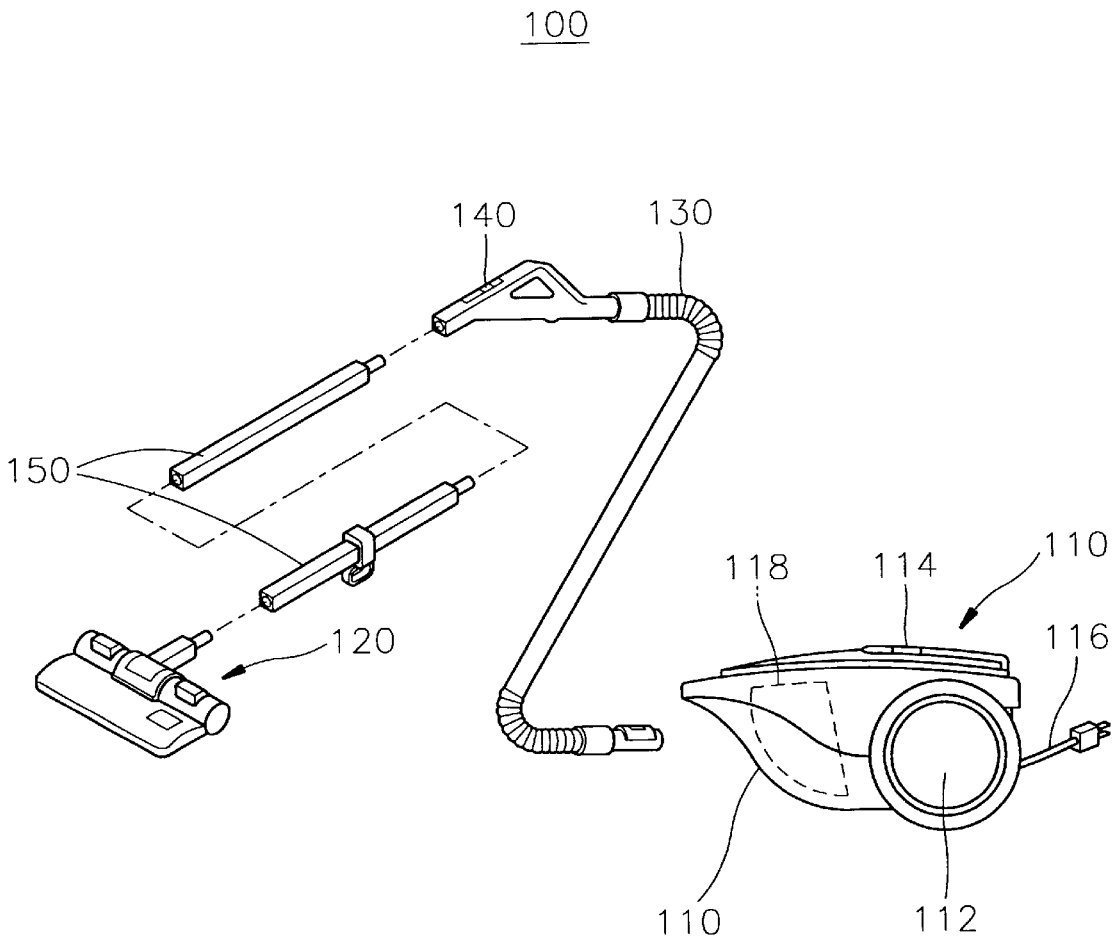
FIG. 1 (PRIOR ART)
FIG. 1 is a perspective view showing a conventional vacuum cleaner.
Figure 2A:
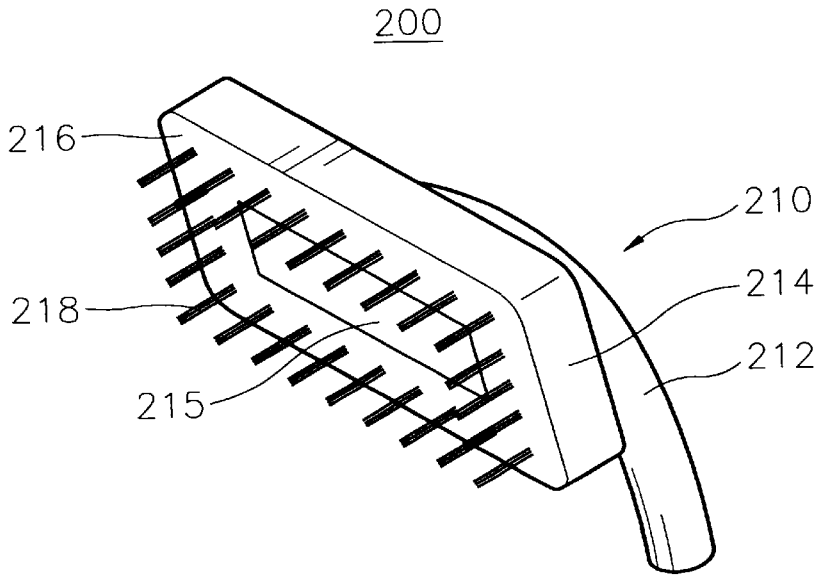
FIG. 2A (PRIOR ART)
FIG. 2A is a perspective view showing a conventional brush assembly for a vacuum cleaner.
Figure 2B:
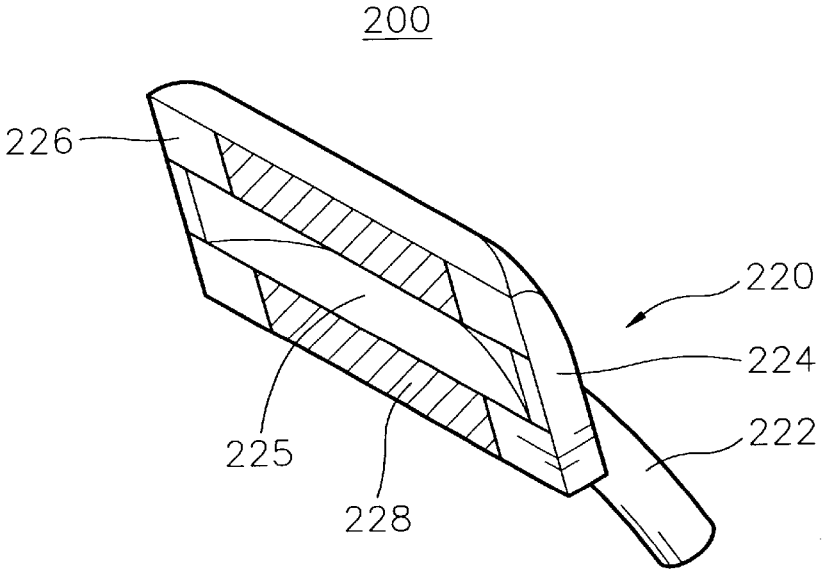
FIG. 2B (PRIOR ART)
FIG. 2B is a perspective view showing another conventional brush assembly for a vacuum cleaner.
Figure 3:
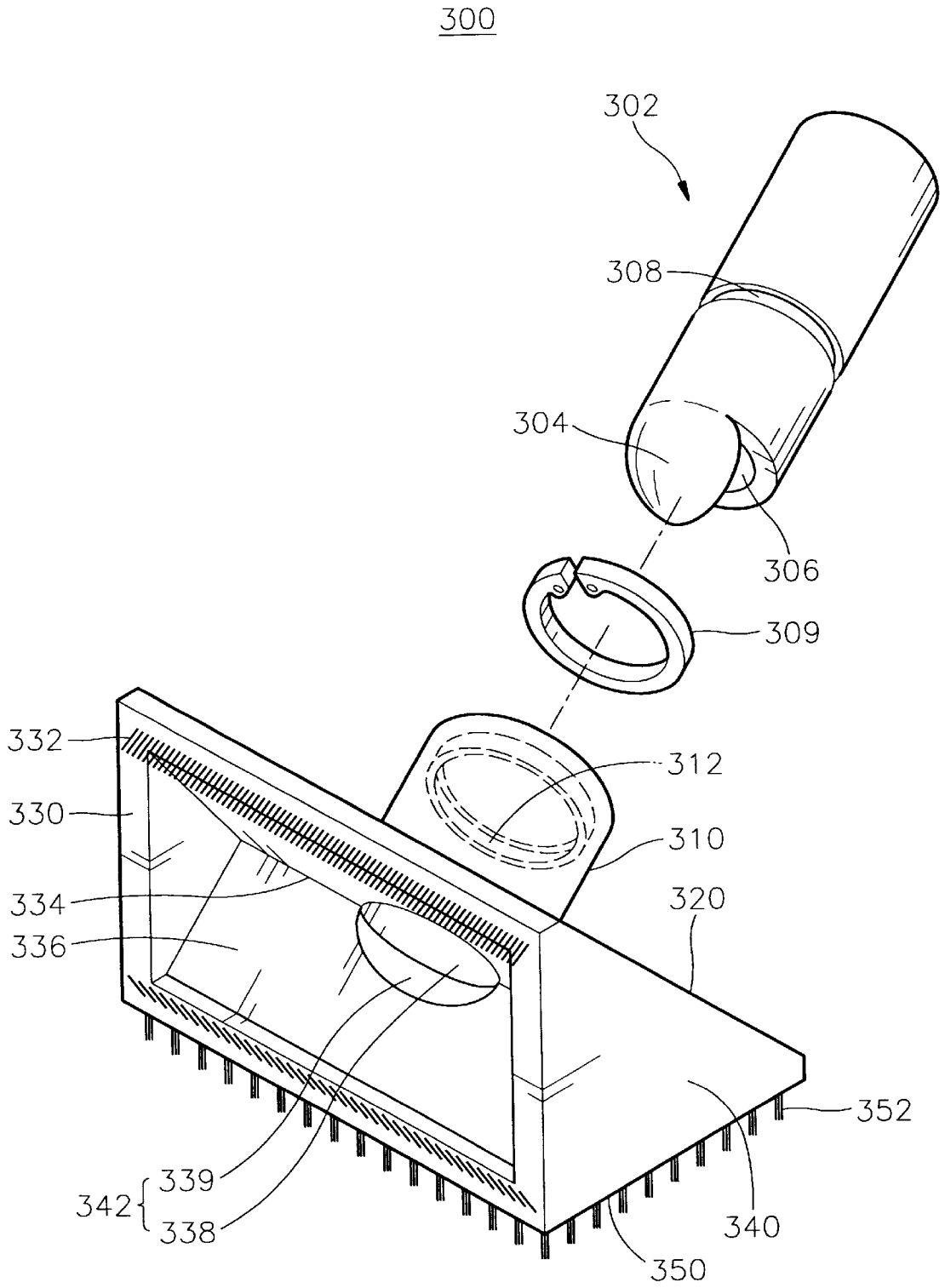
FIG. 3 is a perspective view showing a brush head assembly for a vacuum cleaner according to the present invention.

FIG. 3 illustrates a brush head assembly 300 for a vacuum cleaner according to the present invention. As shown in FIG. 3, brush head assembly 300 comprises a brush head body 340 having a triangle structure including a vertical plane 330 to which an upholstery brush 332 is attached, a lower plane 350 which is horizontally formed at a lower portion of vertical plane 330 and having a dusting brush 352 attached thereunder, and an inclined plane 320 which is formed between vertical plane 330 and lower plane 350. A connecting pipe 310 is integrally formed on inclined plane 320 of brush head body 340 and extends upward at an angle of 90 degrees with respect to inclined plane 320. In addition, a neck pipe 302 is coupled to connecting pipe 310. Neck pipe 302 has a front end portion 304 having a hemisphere shape which is inserted into connecting pipe 310, a rear end portion which is inserted into an extension bar 392 (shown in FIG. 4), and an inlet hole 306 which is formed below the hemisphere shaped front end portion. Brush head body 340 is rotatable about neck pipe 302 so that vertical plane 330 and lower plane 350 alternately make contact with a floor as brush head body 340 rotates.

Generally, dusting brush 352 is used for cleaning a floor or a window frame. Dusting brush 352 prevents brush head body 340 from adhering to the floor because of a suction due to the operation of a blower assembly, so that dust or impurities adhering to the floor are easily separated from the floor. Dusting brush 352 is attached to an edge portion of lower plane 350.

Upholstery brush 332 is used for removing a thread or hairs which adheres to a carpet or a sofa. Upholstery brush 332 is attached to an edge portion of vertical plane 330 and is inclined toward a longitudinal center line of vertical plane 330 in order to easily remove dust or impurities. Inclined plane 320 is inclined at an angle of 45 degrees with respect to lower plane 350.

Figure 4:
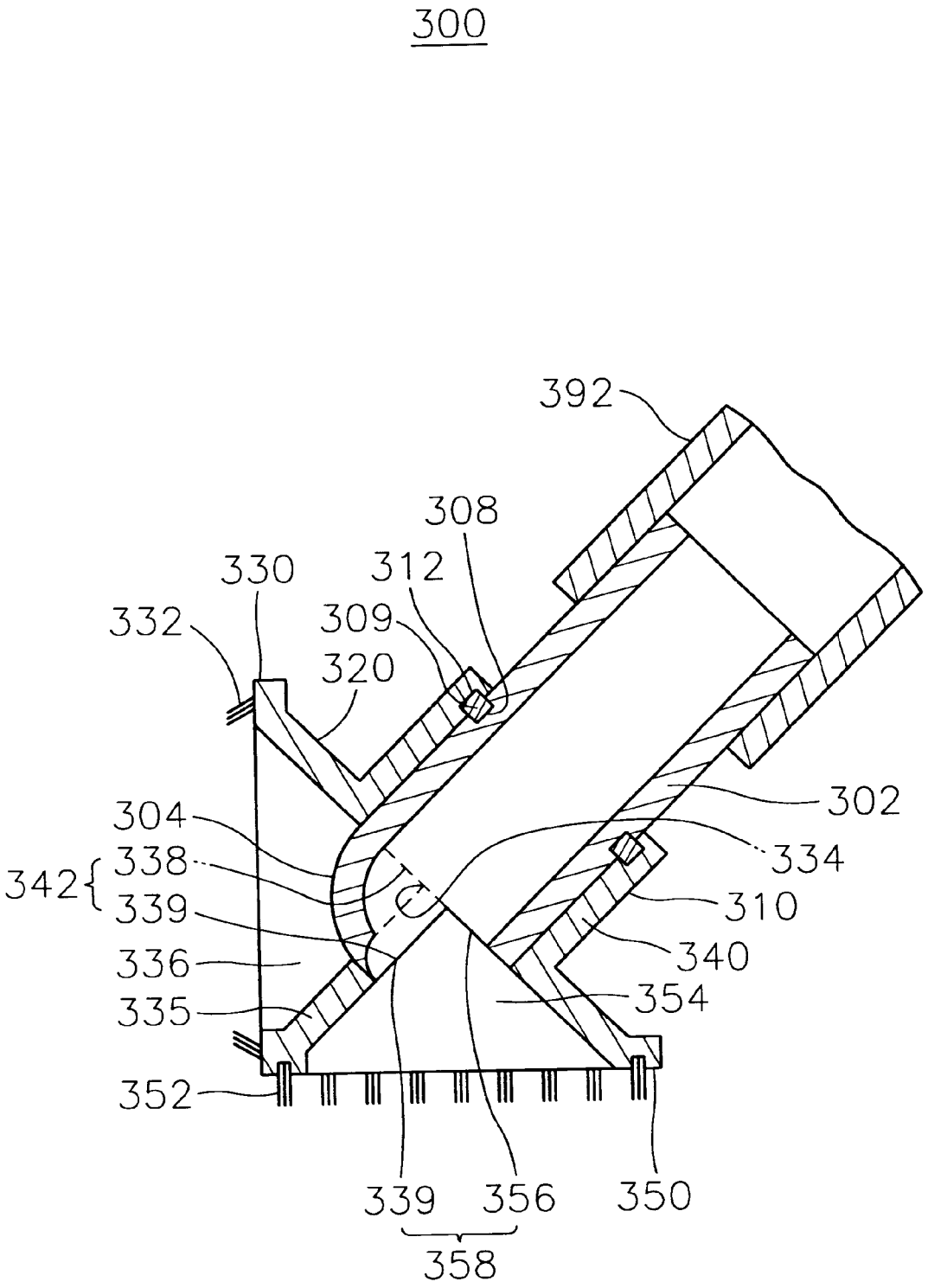
FIG. 4 is a sectional view showing a brush head assembly for a vacuum cleaner according to the present invention.

As shown in FIGS. 3 and 4, connecting pipe 310 is formed at an inner circumference surface thereof with a slot 312 into which a ring 309 is inserted. In addition, neck pipe 302 is formed at an outer circumference surface thereof with a slot 308 into which ring 309 is inserted.

Ring 309 is firstly inserted into slot 308 of neck pipe 302, and then, ring 12 is inserted into slot 312 when neck pipe 302 is assembled into connecting pipe 310. Accordingly, connecting pipe 310 is rotatable with respect to neck pipe 302 by ring 309, and brush head body 340 integrally formed with connecting pipe 310 is also rotatable with respect to neck pipe 302.

A first V-shaped depression part 336 is formed at vertical plane 330 of brush head body 340, and a second V-shaped depression part 354 is formed at lower plane 350 of brush head body 340. First and second V-shaped depression parts 336 and 354 provide a space between the floor and brush head assembly 300 so that suction force generated by the blower assembly is effectively exerted on dust or impurities. A partition 335 is provided between first and second V-shaped depression parts 336 and 354.

First V-shaped depression part 336 is formed with a first suction hole 342 defined by a first semicircular opening 338 and a second semicircular opening 339 which are formed opposite to each other about a longitudinal center axis of first V-shaped depression part 336.

Second V-shaped depression part 354 is formed with a second suction hole 358 defined by second semicircular opening 339 and a third semicircular opening 356 which are formed opposite to each other about a longitudinal center axis of second V-shaped depression part 354. Second semicircular opening 339 is formed at partition 335, so first and second V-shaped depression parts 336 and 354 are communicated with each other.

When cleaning is carried out using upholstery brush 332, the user rotates brush head body 340 by an angle of 180 degrees from the position shown in FIG. 4. As a result, upholstery brush 332 makes contact with the floor. At this time, inlet hole 306 formed below front end 304 of neck pipe 302 is communicated with first suction hole 342 of first V-shaped depression part 336. In contrast, second suction hole 358 formed at second V-shaped depression part 354 is closed by front end portion 304 of neck pipe 302.

Accordingly, suction force generated by the blower assembly is transferred to first V-shaped depression part 336 through extension bar 392 and neck pipe 302, so dust or impurities is sucked and collected in a collecting chamber through first suction hole 342, neck pipe 302 and extension bar 392.

On the other hand, when cleaning is carried out using dusting brush 352, the user again rotates brush head body 340 by an angle of 180 degrees from the position in which upholstery brush 332 makes contact with the floor. As a result, dusting brush 352 makes contact with the floor.

At this time, inlet hole 306 formed below front end 304 of neck pipe 302 is communicated with second suction hole 358 of second V-shaped depression part 354. In contrast, first suction hole 342 formed at first V-shaped depression part 354 is closed by front end portion 304 of neck pipe 302.

Accordingly, suction force generated by the blower assembly is transferred to second V-shaped depression part 354 through extension bar 392 and neck pipe 302, so dust or impurities are sucked and collected in the collecting chamber through second suction hole 358, neck pipe 302 and extension bar 392.

As described above, the brush head assembly for a vacuum cleaner can be used at various places to be cleaned without changing the brush assembly, so cleaning efficiency is improved.

Furthermore, the brush head assembly of the present invention can be simply manufactured by a molding process, so the manufacturing cost is reduced.

In addition, the brush head assembly of the present invention has a simple construction and can be easily handled.

While the present invention has been particularly shown and described with reference to a preferred embodiment thereof, it will be understood by those skilled in the art that various changes in form and detail may be effected therein without departing from the spirit and scope of the invention as defined by the appended claims.

What is claimed is:

1. A brush head assembly for a vacuum cleaner, the brush head assembly comprising:

a brush head body having a triangle structure including a vertical surface to which an upholstery brush is attached, a lower surface which is formed horizontally at a lower portion of the vertical surface and having a dusting brush attached thereunder, and an inclined surface connecting the vertical surface and the lower surface, the vertical surface being formed with a first V-shaped depression part, and the lower surface is formed with a second V-shaped depression part;

a connecting pipe which is integrally formed on the inclined surface of the brush head body and extends upward at an angle of 90 degrees with respect to the inclined surface; and a neck pipe having a front end portion having a hemisphere shape which is inserted into the connecting pipe, a rear end portion which is inserted into an extension bar, and an inlet hole which is formed below the hemisphere shaped front end portion, wherein the brush head body is rotatable about the neck pipe so that the vertical surface and the lower surface alternately make contact with a floor as the brush head body rotates.

2. The brush head assembly for a vacuum cleaner as claimed in claim 1, wherein the inclined surface is inclined at an angle of 45 degrees with respect to the lower surface.

3. The brush head assembly for a vacuum cleaner as claimed in claim 2, wherein the connecting pipe is formed at an inner circumference surface thereof with a slot into which a ring is inserted.

4. The brush head assembly for a vacuum cleaner as claimed in claim 2, wherein the neck pipe is formed at an outer circumference surface thereof with a slot into which a ring is inserted.

5. The brush head assembly for a vacuum cleaner as claimed in claim 1, wherein the first V-shaped depression part is formed with a first suction hole defined by a first semicircular opening and a second semicircular opening which are formed opposite to each other about a longitudinal center axis of the first V-shaped depression part, and the second V-shaped depression part is formed with a second suction hole defined by the second semicircular opening and a third semicircular opening which are formed opposite to each other about a longitudinal center axis of the second V-shaped depression part.

6. The brush head assembly for a vacuum cleaner as claimed in claim 5, wherein the first and second suction holes are communicated with the connecting pipe.

7. A brush head assembly for a vacuum cleaner as claimed in claim 1, wherein the upholstery brush attached to the vertical surface of said brush head body is inclined toward a center of said vertical surface.

8. A brush head assembly for a vacuum cleaner as claimed in claim 1, wherein the inlet hole has a semicircular shape.

* * * * *